US005467628A

United States Patent [19]

Bowlin et al.

[11] Patent Number: 5,467,628

[45] Date of Patent: Nov. 21, 1995

[54] CAN BOTTOM REPROFILER

[75] Inventors: Geoffrey R. Bowlin; Joseph G. Schill, both of Lynchburg; Alexander A. Henzel, Forest, all of Va.

[73] Assignee: Belvac Production Machinery, Inc., Lynchburg, Va.

[21] Appl. No.: 189,243

[22] Filed: Jan. 31, 1994

[51] Int. Cl.[6] ..... B21D 51/26

[52] U.S. Cl. ..... 72/126; 72/94; 72/125

[58] Field of Search ..... 72/94, 110, 111, 72/117, 125, 126

[56] References Cited

U.S. PATENT DOCUMENTS 4,294,097 10/1981 Gombas ..... 72/94

5,069,052 12/1991 Porucznik et al. ..... 72/110

*Primary Examiner*—Lowell A. Larson

*Attorney, Agent, or Firm*—Popham, Haik, Schnobrich & Kaufman, Ltd.

[57] ABSTRACT

An apparatus for reshaping a container includes a number of reprofiler rollers supported by a mounting block that allows the rollers to travel along a circular path lying in a plane perpendicular to an axis along which the mounting block can be driven by a tooling ram. The mounting block and reprofiler rollers are rotated about the axis by a tooling drive shaft that is supported within the tooling ram. Removable spacers are provided between the reprofiler rollers and the mounting block and between the tooling drive shaft and the mounting block in order to provide a way of adjusting the radial and axial positions respectively of the rollers.

15 Claims, 5 Drawing Sheets

CAN BOTTOM REPROFILER

BACKGROUND OF THE INVENTION

1. Field of the Invention

The present invention relates to an apparatus and method for forming containers, and more particularly, an apparatus and method for reshaping the outer surface of the bottom end of a container which has been formed of aluminum or other metal.

2. Related Art

U.S. Pat. No. 4,768,672 describes a drawn and ironed container or can having a reduced neck around an upper end and a bottom profile which allows nesting with a similar container having such a reduced neck. As stated in U.S. Pat. No. 4,768,672, which is herein incorporated by reference, the use of such reduced neck cans has allowed a considerable savings in metal used by manufacturers of such cans.

U.S. Pat. No. 4,885,924 shows a method of reshaping a container having a side wall and a bottom wall, the container being rotated by support means while a roller is applied to the outer periphery of the bottom of the container and moved towards the container axis. The movement of the roller towards the container axis reshapes a transition wall connecting the side and bottom walls of the container.

The apparatus of U.S. Pat. No. 4,885,924 requires the movement of a work roller radially with respect to the longitudinal axis of a container body, and therefore requires the movement of the work roller in a direction perpendicular to the direction of a force applied to the container for holding it in position during the operation. This requirement creates vibration flowing from the complexity of movements and the mechanism so as to limit the maximum speed of operation and cause difficulty in timing the various operations in a high speed container reshaping machine.

SUMMARY OF THE INVENTION

The primary object of the present invention is to provide a new and improved method and apparatus for reshaping the end of a container.

In addition, the present invention is provided with a means for easily adjusting the diameter of the annular ring on the bottom of a reprofiled container in order to allow for stacking of the reprofiled container on similar containers with a variety of reduced neck diameters.

A first embodiment of the present invention includes a plurality of substantially identical processing stations. Each of these processing stations includes two facing turrets, namely, a tool turret and a feed turret. The tool turret has a plurality of circumferentially spaced tooling rams, each of which has a rotating, spinning head upon which are mounted four reprofiler rollers. The other of the facing turrets has a plurality (equal to the number of tooling rams) of circumferentially spaced can push rams each of which is in alignment with a respective tooling ram. A transport starwheel, which may or may not include vacuum can retaining means, is fixed between the two facing turrets and rotates in synchronism with them. Additionally, infeed and outflow starwheels are provided radially outwardly from said main starwheel and provide means for quickly and effectively transferring can bodies to and from the main vacuum starwheel between the two facing turrets. Details of a method and apparatus for transferring can bodies to and from the plurality of identical processing stations are described in pending U.S. patent application Ser. No. 08/069,006, (hereinafter referred to as the "Bowlin et al." application) filed May 28, 1993, which is incorporated herein by reference since such means are used in the preferred embodiment of the present invention.

Each can is transported into a working position aligned with a tooling ram by the starwheel. A can push ram is then actuated by a push ram drive cam to engage the aligned can to move it axially toward the tooling ram by pushing the can axially toward the reprofiler rollers on the tooling ram. When the can push ram has reached its full stroke, the can which is still on the starwheel is in work position to be reprofiled. The tooling ram then is moved toward the can by a tool drive cam, bringing its spinning head with the reprofiler rollers orbiting the can axis and moving into contact with the outer periphery of the can base. Continued advancement of the reprofiler rollers causes the rollers to more forcefully engage the can base and reform it inwardly while making a number of orbits about the can before they are retracted back to their original position. The push ram retracts and the starwheel moves the can forward to its next position.

The reprofiler rollers are all mounted "out of synch" at different angles to each other to prevent the formation of four dents in the can when they initially come into contact with the can base.

Thus, the first embodiment of the present invention includes each tooling ram having a plurality of reprofiler rollers; a roller mounting block for supporting the rollers to travel along a predetermined circular orbital path in a plane perpendicular to the mounting block axis and having a center of curvature positioned coextensive with the can axis; a tooling drive shaft which is connected to the roller mounting block and rotates the roller mounting block about its axis coextensive with the can axis; with a tooling ram subassembly moving the mounting block axially along the central axis toward or away from the can.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
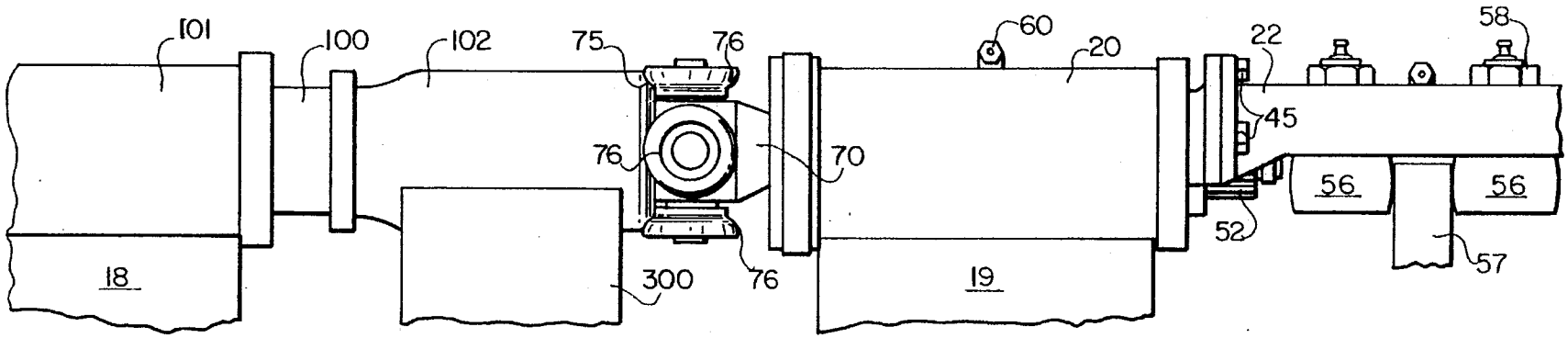
FIG. 1 illustrates a fragmentary view of one of the processing stations of the present invention.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

FIG. 1 shows a portion of one of a plurality of identical processing stations 15, each of which is mounted on a radial extension 16 of a horizontal main support shaft 210 which is supported for rotation on a fixed frame (not shown) and driven in the manner of shaft 110 of the Bowlin et al. application incorporated herein by reference. A tool drive ram assembly 22 is shown activated by reactive engagement of cam followers 56 with a fixed cam 57 (FIG. 7) so that reprofiler rollers 76 are pressed against the bottom of a can 102 which is held in position between the tool drive ram assembly 22 and a can push ram 100 by a conventional starwheel 300 which can optionally be a vacuum starwheel if desired. Can push ram 100 is mounted for reciprocation in a slide bushing 101. Cam followers 103 on the outer end of ram 100 engage a fixedly positioned cam 104 so that rotation of shaft 210 causes reciprocation of push ram 100.

Figure 2:
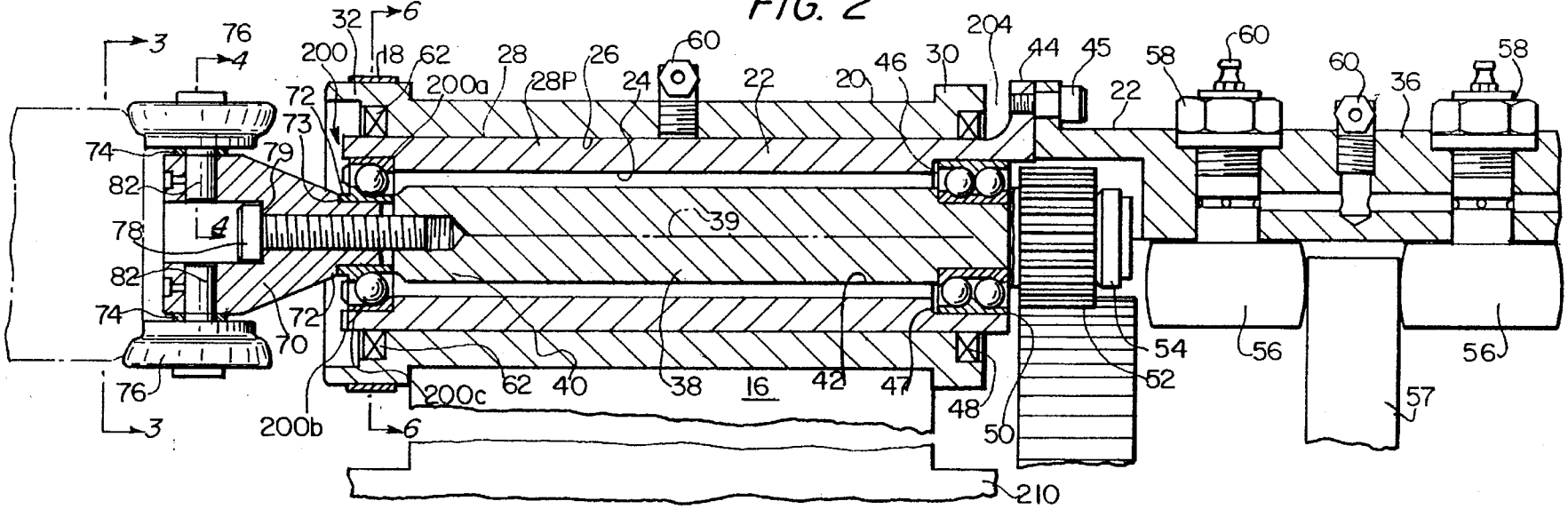
FIG. 2 is a cross-sectional view of a tooling ram.

The tool drive ram assembly 22 has a first end 28 and a second end 36 as shown in FIG. 2. First end 28 of tool drive ram assembly 22 is substantially cylindrical in shape and has a central axial bore 24 passing therethrough. Ram assembly first end 28 is connected to ram assembly second end 36 by an intermediate connecting portion 44 and machine screws 45.

Cam followers 56 are secured to ram assembly second end 36 by cam follower retainer nuts 58. Cam followers 56 move along the surface of fixed cam 57 as the tooling ram turret, is rotated about is center support means. Movement of cam followers 56 along this cain surface causes tool drive ram assembly 22 to reciprocate along a central axis passing through ram assembly first end 28 toward and away from vacuum star wheel 300 and a can 102 thereon. End 28 of tool drive assembly 22 is concentrically and slidably received within an axial bore 26 in a slide bushing 20. Slide bushing 20 is also substantially cylindrical in shape and has a first end 32 and a second end 30. The outer periphery of tool drive ram assembly first end 28 matingly fits closely to the inner surface of bore 26 of slide bushing 20. A smooth fit between slide bushing 20 and the tool drive ram assembly 22 is ensured by the presence of grease applied to their mating surfaces through grease fitting 60, and sealed against escaping from the space between their mating surfaces by oil seals 62 provided at each end of slide bushing 20.

Figure 6:
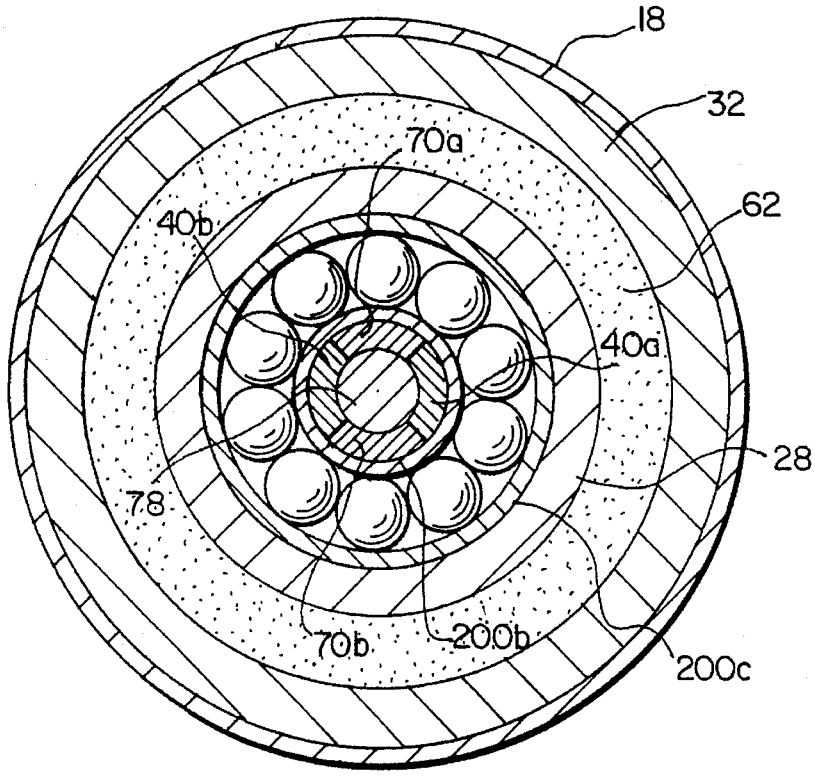
FIG. 6 is a transverse section taken through the ball bearing supporting one end of the tooling drive shaft.

As shown in FIG. 2, a tooling drive shaft 38 is concentrically and rotatably mounted within ram assembly first end 28. Tooling drive shaft 38 is located within ram assembly central axial bore 24 and has a first end 40 and a second end 42. As shown in FIG. 2 and FIG. 6, tooling drive shaft first end 40 is rotatably supported in ram assembly first end 28 by an angular contact type ball bearing assembly 200, which allows the transmittal of axial thrust forces from ram assembly 22 to a reprofiler roller mounting block 70. Inner race **200*b* of ball bearing assembly 200 rests against a pivot base shim 72 which separates inner bearing race 200*b* from an annular shoulder 73 on the mounting block 70. Tooling drive shaft second end 42 is supported in tooling ram assembly 22 by a self-aligning type ball bearing assembly 204. Self-aligning ball bearing assembly 204 is separated from a shoulder 47 in ram assembly 22 by "Belleville" washers 46. Self-aligning ball bearing assembly 204 compensates for any minor misalignments between tooling drive shaft 38 and tooling ram assembly 22 and applies pre-load force to bearing 200**.

As shown in FIG. 2, a pinion drive gear 52 is keyed to tooling drive shaft second ,end 42. Pinion drive gear 52 is held on tooling drive shaft second end 42 by a bearing lock nut 54. Pinion drive gear 52, along with each of the pinion drive gears provided on the other tooling ram assemblies in a single turret is engaged with a single large stationary central bull gear 53 (FIG. 8) as shown in the Bowlin et al. application, which is incorporated herein by reference. Tooling drive shaft 38 is rotated by the orbital rotation of pinion drive gear 52 around fixedly positioned bull gear 53 and, as described in further detail below, rotates reprofiler roller mounting block 70.

Figure 5:
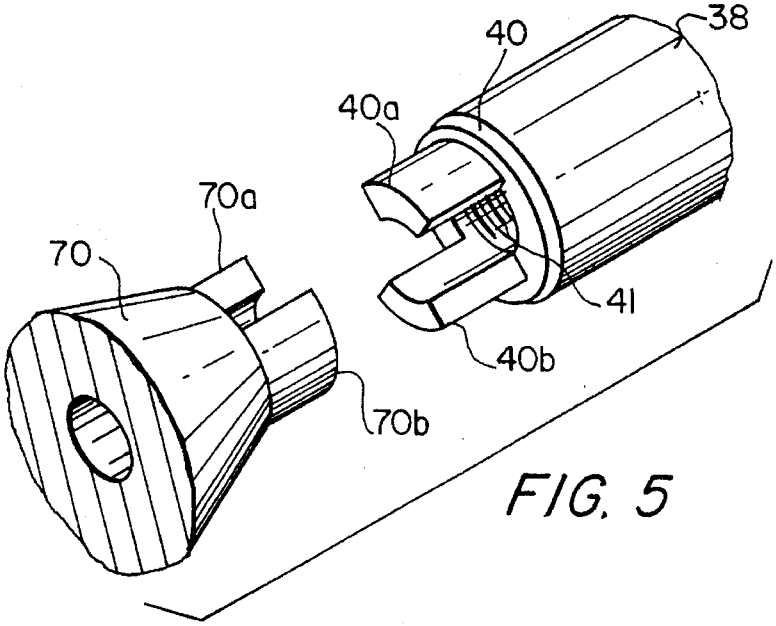
FIG. 5 is an exploded perspective view of the connection between the mounting block and the tooling drive shaft.

As shown in FIG. 5, tooling drive shaft first end 40 has two circumferentially spaced, axially extending tangs **40*a* and 40*b*. These tangs are spaced 180° apart from each other, and extend axially from an annular shoulder at the tooling drive shaft first end 40. A blind bore 41 extends axially inwardly from first end 40 of tooling drive shaft 38. Blind bore 41 is internally threaded for threaded engagement with a mounting block retainer screw 78 as shown in FIG. 2**.

Mounting block 70 also has two circumferentially spaced, axially extending tangs **70*a* and 70*b*. Tangs 70*a* and 70*b* are spaced 180° apart from each other and intermesh or interleave with tangs 40*a* and 40*b* of the tooling drive shaft 38 when mounting block 70 is connected to tooling drive shaft 38 by screw 78 as shown in FIG. 2. Mounting block screw 78 is seated in an axially extending counterbore 79 of mounting block 70. The threaded portion of screw 78 engages with internally threaded blind bore 41 of tooling drive shaft 38**.

Figure 3:
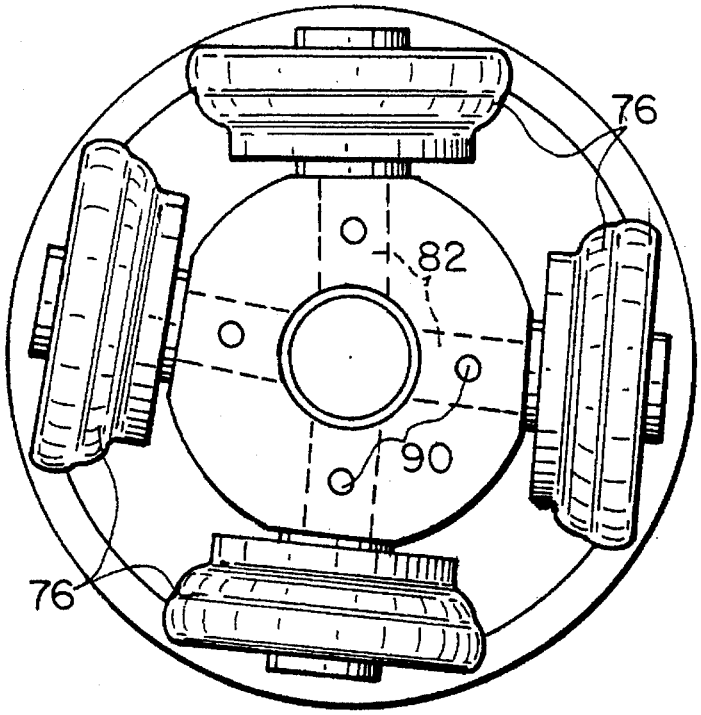
FIG. 3 is an end view of the tooling ram taken along line 3—3 of FIG. 2 showing the four reprofiler rollers mounted to the mounting block.
Figure 4:
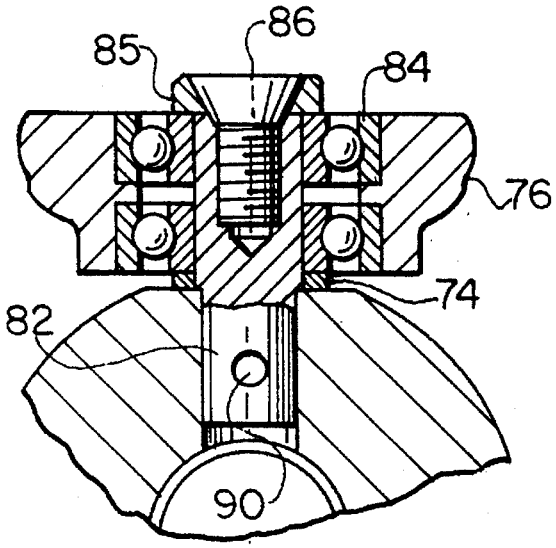
FIG. 4 is a cross-sectional view of one of the reprofiler rollers taken along line 4—4 of FIG. 2.

At an axial end of mounting block 70 opposite from axially extending tangs **70*a* and 70*b*, four reprofiler roller mounting shafts 82 are supported in radially extending bores that pass from the outer periphery of mounting block 70 through to central axial counterbore 79. The central axes of mounting shafts 82 lie in a plane perpendicular to the central axis of mounting block 70. Mounting shafts 82 are also circumferentially spaced non-equal distances such that none of the mounting shafts are in axial alignment as will be apparent from FIG. 3. Mounting shafts 82 are fixed in their radially extending bores by set screws 90 as shown in FIG. 4**.

Each mounting shaft 82 supports a reprofiler roller 76 which is spaced from the outer periphery of mounting block 70 by a reprofiler roller spacer 74. Reprofiler rollers 76 are mounted for rotation on mounting shafts 82 by ball bearings 84. Ball bearings 84 are retained on the radially outer portions of mounting shafts 82 by bearing retainer washers 85 and bearing retainer screws 86. This arrangement allows for a quick and efficient replacement of spacer 74 when a spacer having a different thickness dimension is desired. Adjustment of the radius of the circular orbital path traveled by reprofiler rollers 76 is thereby facilitated by replacing the spacer with another spacer of different thickness, and the resultant profile of processed cans is easily and accurately controlled.

Figure 8:
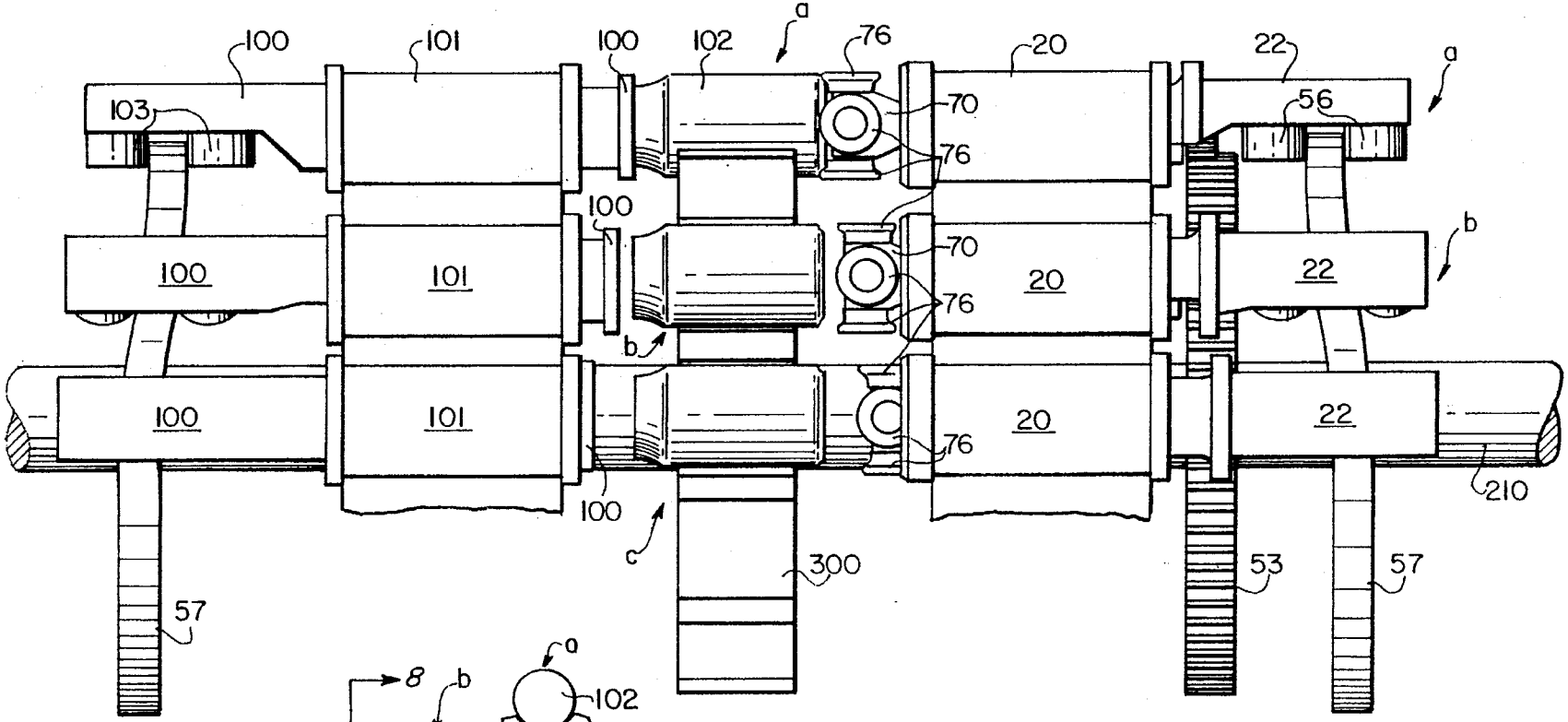
FIG. 8 is a partial side view taken in the direction of arrows 8—8 in FIG. 7.
Figure 7:
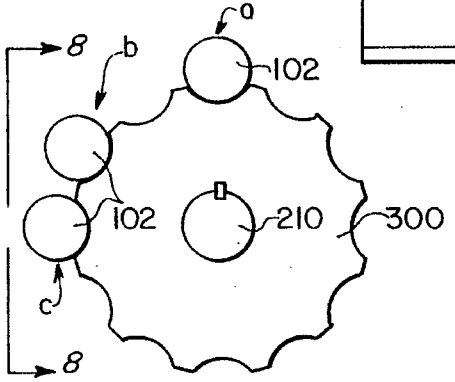
FIG. 7 is a partial end view of the vacuum star wheel and showing three tooling rams circumferentially spaced in a single tool turret.

FIGS. 7 and 8 illustrate a cycle of operation showing three can positions a, b and c (a can is not shown in the position between positions a and b since it would obscure the can in position a). After a can 102 has been brought into position c for processing, it is held in position by starwheel 300, the can push ram 100 is activated to move the bottom end of can 102 into a position facing, but closely spaced from, rollers 76 as in position b and rollers 76 are moved axially toward can 102 by the cooperation of cam followers 56 with stationary cam 57. Reprofiler rollers 76 are brought into engagement with the bottom of can 102 at position a at a relatively slow pace, and are free to rotate about their axes. The reprofiler rollers orbit the axis 39 of tooling drive shaft 38 as a result of the rotation of tooling drive shaft 38. On an average, after making full contact with the bottom of a can, reprofiler rollers 76 will traverse 2–3 complete revolutions around the can while being moved toward the can to progressively increase contact with the can before being retracted axially away from the can. The last complete revolution of the rollers 76 around the bottom of can 102 serves to iron out any dents created upon initial contact between rollers 76 and the can 102. The likelihood of the creation of dents in the cans upon initial contact with rollers 76 is reduced by the rollers being offset relative to each other as shown in FIG. 3.

Tooling drive shaft 38, and therefore mounting block 70 and rollers 76, are continuously rotated by pinion drive gear 52, which is always meshed with the fixedly positioned large central bull gear 53. Therefore, rollers 76 continue to traverse a closed path and orbit the axis 39 of tooling drive shaft 38 even as tooling assembly 22 is moved axially into and out of contact with can 102. Tangs **70*a* and 70*b* of mounting block 70 in engagement with tangs 40*a* and 40*b* of tooling drive shaft 38, ensure that tooling drive shaft 38 will not become separated from mounting block 70, regardless of the direction of rotation of tooling drive shaft 38. Upon completion of the can working, ram 100 is retracted to the left and rollers 76 are retracted to the right to permit outfeed of the can from starwheel 300**.

In addition to providing a means for transmitting axial thrust from tool drive ram assembly 22 to mounting block 70, pivot base shim 72 provides an additional means for adjusting the axial position of reprofiler rollers 76 by the use of shims having different thicknesses as will be apparent from inspection of FIG. 2. This feature makes the apparatus more adaptable for use with cans of varying height dimensions with changeover from one can size to another being quickly and easily accomplished.

Figure 9:
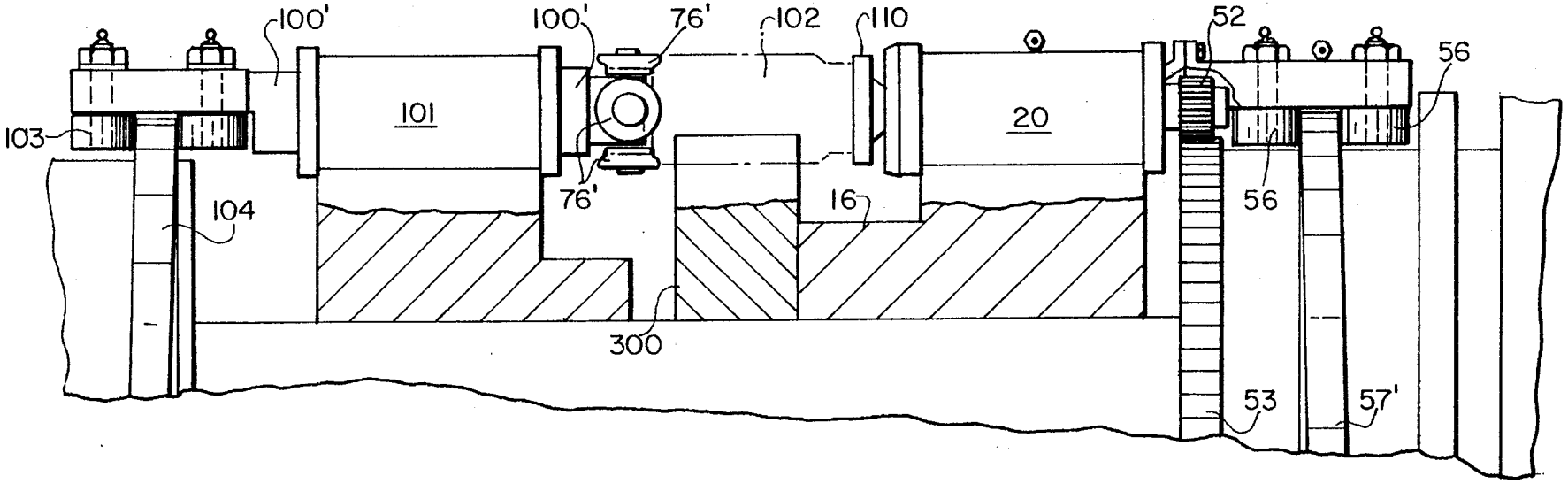
FIG. 9 is a partial side and sectional view of a second embodiment of the invention.

FIG. 9 illustrates a second embodiment of the invention in which the reprofiler rollers are not moved into contact with the can but are instead held in a stationary position and the can is moved against the rollers with the can being concurrently rotated. More specifically, four reprofiler rollers 76' are mounted on the inwardly facing end of a ram 100' which is identical to ram 100 with the exception of the fact that ram 100' does not have a can push member but instead provides support for the reprofiler rollers 76'. Ram 100' is mounted for reciprocation in bushing 101 and such reciprocation is effected by the reaction of cam followers 103 with the fixedly positioned cam 104' in a manner analogous to the operation of the first embodiment.

The second embodiment includes a spinning push pad attached to the first end 40 of drive shaft 38 in exactly the same manner that the reprofiler roller mounting block 70 is attached to shaft 38 in the first embodiment. The spinning push pad includes first and second tangs identical to tangs **70*a* and 70*b* of the first embodiment which engage the tangs 40*a* and 40*b* on the end of shaft 38**.

In operation, the whole assembly rotates with shaft 210 and cam 104' moves the ram 100' into facing relationship to the bottom of can 102 but closely spaced therefrom. Reaction of cam followers 56 with cam 57' moves rotating shaft 38 to the left so that spinning push pad 110 engages a can and urges it against the reprofiler rollers 76' while concurrently rotating the can about its axis so that there is relative movement between the can and the reprofiler rollers 76' which merely rotate about their own individual axes but which do not orbit the axis of ram 100' in the manner that roller 76 orbits the axis of block 70. Upon completion of the reforming of the can bottom, the reprofiler rollers 76 are moved to the left from their FIG. 9 position and the spinning push pad 110 is moved to the right from its FIG. 9 position so as to permit discharge of the can away from the turret 300. Thus, the second embodiment operates by rotating the can while holding the reprofiler rollers 76' for rotation in a fixed position. The axes of the rollers on opposite sides of the ram 100' can be aligned with each other or can alternatively be unaligned in the manner analogous to the mounting of the rollers 76 of the first embodiment.

Modifications and variations of the above-described embodiments of the present invention are possible, as appreciated by those skilled in the art in light of the above teachings. For instance, means other than a starwheel could be used for feeding and holding cans during the processing of cans. Also, the timing of operations can be varied so that, for instance, a can push ram would move a can axially towards a respective tooling ram and into contact with orbiting reprofiler rollers mounted on the tooling ram as in the first embodiment during the reprofiler operation, rather than the tooling ram moving the reprofiler rollers into contact with the can. Also, the reprofiler rollers do not have to be "out of synch" with each other but could be spaced 90° apart.

It is therefore to be understood that, within the scope of the appended claims and their equivalents, the invention may be practiced otherwise than as specifically described.

16 - radial extension
20 - slide bushing
22 - tool drive assembly
24 - tool drive assembly central axial bore
26 - slide bushing inner diameter
28 - tool drive assembly first end
28P - outer peripheral surface of 28
30 - slide bushing second end
32 - slide bushing first end
36 - tool drive assembly second end
38 - tooling drive shaft
39 - axis of tooling drive shaft
40 - tooling drive shaft first end
**40*a*** - tooling drive shaft first tang
**40*b*** - tooling drive shaft second tang
41 - blind bore
42 - tooling drive shaft second end
44 - ram assembly intermediate connecting portion
45 - machine screws
46 - Belleville washer
47 - ram assembly shoulder
48 - ram bushing cut-out portion
50 - pinion drive gear spacer washer
52 - pinion drive gear
53 - bull gear
54 - bearing lock nut
56 - cam follower
57 - cam
58 - cam follower nut
60 - grease fitting
62 - oil seal
70 - reprofiler roller mounting block

70a - reprofiler roller mounting block first tang
70b - reprofiler roller mounting block second tang
72 - pivot base shim
73 - mounting block shoulder
74 - reprofiler roller spacer
75 - reprofiler roller profile
76 - reprofile roller
78 - mounting block screw
79 - mounting block counterbore
82 - reprofiler roller mounting shaft
84 - mounting shaft bearing
85 - bearing retainer washer
86 - bearing retainer screw
90 - mounting shaft set screw
100 - can push ram
102 - can
200 - angular contact ball bearing assembly
200a - angular contact bearing balls
200b - angular contact bearing inner race
200c - angular contact bearing outer race
204 - self-aligning type ball bearing assembly
300 - vacuum starwheel

What is claimed is:

1. An apparatus for reshaping ends of cylindrical containers having a longitudinal axis, a side wall and a bottom end, said apparatus comprising:

a) a tool drive ram assembly having a first end, a second end, a central axis, and a central axial bore;

b) a substantially cylindrical, ram slide bushing having a first end, a second end, and an axial bore through which said tool drive ram assembly is concentrically and slidably received for axial reciprocation;

c) a tooling drive shaft concentrically mounted for rotation within the tool drive ram assembly central axial bore and having a first end, a second end and a central axis coinciding with the tool drive ram assembly central axis;

d) a plurality of reprofiler rollers, each having an axis of rotation;

e) means for supporting a can in axial alignment with said central axis;

f) mounting means connected to the first end of said tooling drive shaft for supporting said reprofiler rollers for rotation with their axes of rotation having a component substantially perpendicular to the central axis of the tooling drive shaft and with said rollers being positioned so that movement of the tool drive ram assembly toward the can effects contact of the reprofiler rollers with the can to reconfigure the end of the can;

g) said mounting means comprising a reprofiler roller mounting block having a first end, a second end, a central axial bore, and an outer periphery;

h) said second end of said mounting block including two circumferentially spaced tangs extending in an axial direction from an annular shoulder that is orthogonal to and surrounding said mounting block central axial bore;

i) a pivot base shim seated against said mounting block annular shoulder for axially spacing said mounting block from said tooling drive shaft first end so as to accurately position said mounting block relative to said drive shaft; and j) roller spacers provided between said mounting block and said reprofiler rollers for accurately establishing the radius of a circular path traveled by said rollers resultant from rotation of said tooling drive shaft.

2. The apparatus of claim 1 wherein said mounting means further includes a plurality of reprofiler roller mounting shafts extending radially through said mounting block from said mounting block central axial bore to said mounting block outer periphery;

said reprofiler rollers being rotatably mounted on said mounting shafts by bearing means;

and said bearing means being retained on said mounting shafts by respective bearing retainer washers;

wherein said axes of rotation of said reprofiler rollers are circumferentially spaced so that no two rollers are axially aligned.

3. The apparatus of claim 1 wherein said tooling drive shaft includes a blind, internally threaded bore extending in from said drive shaft first end along said drive shaft central axis; and said apparatus further including a pinion drive gear fixedly retained on and keyed to said second end of said tooling drive shaft;

and said tooling drive shaft first end including two circumferentially spaced tangs extending in an axial direction from an annular shoulder that is orthogonal to and surrounding said blind, internally threaded bore.

4. The apparatus of claim 3 wherein said mounting block is fixed to said drive shaft first end by a screw passing through said mounting block axial bore and threadedly received in said drive shaft blind bore;

said mounting block tangs intermeshing with said drive shaft tangs;

and including spacers provided between said mounting block outer periphery and said reprofiler rollers for setting the radius of an orbital path traveled by said rollers about the axis of said tooling drive shaft upon rotation of said tooling driving shaft.

5. The apparatus of claim 1 wherein said mounting means is rotatably supported in said tooling ram first end by bearing means for transmitting radial and axial loads between said mounting means and said tooling ram;

wherein said tooling drive shaft second end is rotatably supported in said tooling ram central axial bore by bearing means for compensating for any misalignment between said tooling ram and said tooling drive shaft; and wherein said reprofiler rollers reconfigure the end of the can by engaging the outer surface of the can side wall adjacent the bottom end of the can so as to reduce the diameter of the can in the area engaged by the reprofiler rollers.

6. An apparatus for reshaping a container, said apparatus comprising:

a) a tool drive ram assembly having a guided portion and a driving portion, said guided portion being fixedly connected to said driving portion, and said guided portion having a central axis and a central axial bore;

b) cam followers fixed to said driving portion;

c) a substantially cylindrical ram slide bushing having a first end, a second end, and an axial bore with said tool drive ram assembly guided portion being concentrically and slidably received within said axial bore of said ram slide bushing;

d) a tooling drive shaft having a first end, a second end, and a central axis coinciding with the central axis of said guided portion;

e) a reprofiler roller mounting block connected to said tooling drive shaft first end;

f) a plurality of reprofiler rollers mounted on said roller mounting block, each having an axis of rotation radially oriented relative to said central axis;

g) said tool drive ram assembly driving portion driving said guided portion in an axial direction as said cam followers move along a fixed cam;

h) said tooling drive shaft being concentrically and rotatably mounted within the central axial bore of said guided portion;

i) said reprofiler roller mounting block rotatably supporting said reprofiler rollers with their axes of rotation perpendicular to the central axis of said tooling drive shaft;

j) said reprofiler roller mounting block having a first end, a second end, a central axial bore, and an outer periphery;

k) said second end of said mounting block including two circumferentially spaced tangs extending in an axial direction from an annular shoulder that is orthogonal to and surrounding said mounting block central axial bore;

l) a pivot base shim seated against said annular shoulder and providing means for accurately axially spacing said mounting block relative to said tooling drive shaft first end; and m) spacers provided between said mounting block and said reprofiler rollers for setting a radius of a path traveled by said rollers to a predetermined value.

7. The apparatus of claim 6 wherein said mounting block further includes a plurality of reprofiler roller mounting shafts extending radially through said mounting block from said mounting block central axial bore to said mounting block outer periphery and held in position by respective set screws;

said reprofiler rollers being rotatably mounted on said mounting shafts by roller bearings;

and said roller bearings being retained on said mounting shafts by respective bearing retainer washers;

wherein said axes of rotation of said reprofiler rollers are circumferentially spaced so that no two rollers are mounted 180 degrees from each other.

8. The apparatus of claim 6 wherein said tooling drive shaft has a blind, internally threaded bore extending in from said drive shaft first end along said drive shaft central axis;

said apparatus further including a pinion drive gear keyed to said second end of said tooling drive shaft and retained in position by a bearing lock nut; and said tooling drive shaft first end including two circumferentially spaced tangs extending in an axial direction from an annular shoulder that is orthogonal to and surrounding said blind, internally threaded bore.

9. The apparatus of claim 8 wherein said mounting block is fixed to said drive shaft first end by a screw passing through said mounting block axial bore and threadedly received in said drive shaft blind bore; and said mounting block tangs intermeshing with said drive shaft tangs.

10. An apparatus for reshaping the closed bottom end of a can, said apparatus comprising:

a plurality of reprofiler rollers;

roller mounting means for supporting said rollers to travel along a predetermined circular path having a radius and a central point, said circular path lying on a plane perpendicular to a central axis passing through said central point;

rotating means for rotating said mounting means about said central axis;

can support means for supporting a can in coaxial alignment with said central axis with the can bottom facing said roller mounting means;

driving means for moving said mounting means axially along said central axis to effect engagement of the can bottom with said reprofiler rollers;

said roller mounting means including means for adjusting said radius of said circular path;

said driving means including a first and a second portion;

said driving means first portion having mounted thereon a plurality of cam followers for following a drive cam; and said driving means second portion rotatably supporting said rotating means.

11. An apparatus for reshaping the bottom end of a can, said apparatus comprising:

a plurality of reprofiler idler rollers;

roller mounting means for supporting said idler rollers for travel along a predetermined circular path having a radius and a center of curvature, said circular path lying in a plane perpendicular to a central axis passing through said center of curvature;

means for positioning a can having a bottom end and an adjacent sidewall in axial alignment with said central axis with the bottom end of the can facing said idler rollers so that said adjacent sidewall is in general alignment with said idler rollers;

rotating means for rotating said roller mounting means about said central axis so that said idler rollers orbit said central axis;

movement effecting means for effecting relative movement of said idler rollers and said can toward each other so that said idler rollers engage said adjacent sidewall and effect a reduction in the diameter of portions of said adjacent sidewall;

said roller mounting means including means for selectively enabling variation of the radius of said circular path; and cam follower means mounted on said movement effecting means and engaged with fixedly positioned cam means for effecting movement of said roller mounting means and said idler rollers toward or away from said can in response to rotation of said rotating means.

12. An assembly for supporting a plurality of idler rollers at desired locations along the axis of rotation of a rotary tooling drive member; said assembly comprising a rotary tooling drive member having an outer end, an axis of rotation and circumferentially spaced drive member tangs extending in cantilever manner from the outer end of said rotary tooling drive member; a roller mounting block having a first end facing said rotary tooling drive member, a second end, an axis of rotation and an outer periphery; a plurality of idler roller mounting shafts provided on said roller mounting block and each having an outer end; idler rollers mounted on the outer ends of said idler roller mounting shafts; the first end of said roller mounting block including two circumferentially spaced mounting block tangs extending in an axial direction from the first end of said roller mounting block;

said mounting block tangs being interleaved with said rotary tooling drive member tangs so that rotation of said rotary tooling drive member effects rotation of said roller mounting block; a pivot base shim seated between the first end of said roller mounting block and the outer end of said rotary tooling drive member and comprising means for axially spacing said roller mounting block first end from said rotary tooling drive member outer end; and force exerting means for maintaining said pivot base shim in clamped condition between said roller mounting block and said rotary tooling drive member but being capable of deactivation to allow replacement of said pivot base shim with another shim of different thickness so as to alter the position of said roller mounting block relative to the outer end of said rotary tooling drive member upon subsequent activation of said force exerting means.

13. The assembly of claim 12 additionally including roller spacers provided between said roller mounting block and said idler rollers for setting a radius of a circular path travelled by said idler rollers to a predetermined value.

14. The assembly of claim 12 wherein said idler roller mounting shafts extend radially through said roller mounting block and have an inner end termination adjacent a central axial bore of said roller mounting block; and said idler rollers are rotatably mounted on said idler roller mounting shafts by bearing means retained on said idler roller mounting shafts by respective bearing retainer washers; wherein said idler roller mounting shafts are circumferentially spaced so that no two rollers are axially aligned.

15. The assembly of claim 12 wherein said force exerting means comprises a bolt extending through said roller mounting block and being threadedly engaged with thread means in said rotary tooling drive member.

* * * * *